US008904739B2

(12) United States Patent
Lang

(10) Patent No.: US 8,904,739 B2
(45) Date of Patent: Dec. 9, 2014

(54) METHOD AND DEVICE FOR CLOSING CONTAINERS

(75) Inventor: Horst Lang, Barbing-Auburg (DE)

(73) Assignee: Krones AG (DE)

( * ) Notice: Subject to any disclaimer, the term of this patent is extended or adjusted under 35 U.S.C. 154(b) by 639 days.

(21) Appl. No.: 12/681,553

(22) PCT Filed: Sep. 30, 2008

(86) PCT No.: PCT/EP2008/063093

§ 371 (c)(1),
(2), (4) Date: Jun. 11, 2010

(87) PCT Pub. No.: WO2009/047172

PCT Pub. Date: Apr. 16, 2009

(65) Prior Publication Data

US 2010/0257823 A1 Oct. 14, 2010

(30) Foreign Application Priority Data

Oct. 5, 2007 (DE) ..... 10 2007 047 742

(51) Int. Cl.
*B65B 7/28* (2006.01)
*B67B 3/20* (2006.01)

(52) U.S. Cl.
CPC ..... *B67B 3/2093* (2013.01)
USPC ..... 53/490; 53/317; 53/331.5

(58) Field of Classification Search
CPC .... B67B 3/2073; B67B 3/208; B67B 3/2093; B67B 3/261
USPC ..... 53/490, 317, 75, 76, 331.5
See application file for complete search history.

(56) References Cited

U.S. PATENT DOCUMENTS

| | | | | |
|---|---|---|---|---|
| 5,062,491 | A * | 11/1991 | Takeshima et al. | 173/181 |
| 5,321,935 | A * | 6/1994 | Spatz et al. | 53/490 |
| 5,400,564 | A * | 3/1995 | Humphries et al. | 53/75 |
| 6,874,301 | B2 * | 4/2005 | Kitamoto | 53/490 |
| 2002/0148205 | A1 | 10/2002 | Takebe et al. | |
| 2006/0242929 | A1 * | 11/2006 | Servadei et al. | 53/490 |

FOREIGN PATENT DOCUMENTS

| | | | |
|---|---|---|---|
| EP | 1 249 426 | A1 | 10/2002 |
| WO | 2007/106006 | A1 | 9/2007 |

* cited by examiner

*Primary Examiner* — Stephen F Gerrity
*Assistant Examiner* — Eyamindae Jallow
(74) *Attorney, Agent, or Firm* — Onello & Mello, LLP

(57) ABSTRACT

A method for closing containers with closures by means of a closing device may include screwing closures onto openings of the containers. For closing the containers, a final torque ($D_{end}$) may be prescribed, with which the closing operation is completed, and this final torque ($D_{end}$) is less than a maximum torque ($D_{max}$), which is applied at least once during the overall closing operation.

20 Claims, 2 Drawing Sheets

METHOD AND DEVICE FOR CLOSING CONTAINERS

CROSS-REFERENCE TO RELATED APPLICATION

This application is filed under 35 U.S.C. 371 as a U.S. national phase application of PCT/EP2008/063093, having an international filing date of Apr. 16, 2009, which claims the benefit of German Patent Application No. 10 2007 047 742.4 having a filing date of Oct. 5, 2007, the contents of which are hereby incorporated by reference in their entirety.

TECHNICAL FIELD

The present invention relates to a method and a device for closing containers. Such devices for closing containers have long been known from the prior art. Usually a container for a beverage bottle is filled with the beverage and then closed. During this closing, a screw cap is screwed onto the container. The plastic screw closure which is screwed onto the container should meet a number of requirements. On the one hand, it must ensure leaktightness, even in the case of high internal pressures. Furthermore, it should offer protection against manipulated opening, including by means of a visible tamper-proof strip, and finally the screw closure should be able to be produced at a reasonable price.

BACKGROUND

Various screw closures comprising the aforementioned tamper-proof strips are known from the prior art. When screwing onto the container, these tamper-proof strips are pushed over a ring which is provided at the mouth of the container. When the closure is opened, the tamper-proof strip is unavoidably torn, so that it is easy to see that the container has already been opened once before. In order to meet the increasing demands with regard to guaranteeing the integrity of the product, these tamper-proof strips of the screw closures are being constantly improved and are bearing more and more tightly against the mouth of the bottle.

Due to this tight bearing, however, a very high screwing torque is necessary in order to push the tamper-proof strip over the corresponding ring when the closure is first screwed onto the container. This means that a higher final torque is required from the devices known from the prior art for closing the containers and also in the case of servo closing machines (?), so that the closure enters the seal and thus latches the tamper-proof strip against the mouth. However, this high final torque during the rotation is inconvenient with regard to handling, since it makes it much more difficult to open the bottle.

It may therefore be desirable to provide a device and a method which make it possible to achieve a desired low final torque of the screwed-on closure even when using tightly bearing tamper-proof strips.

SUMMARY

In a method according to the invention for closing containers with closures by means of a closing device, the closures are rotated or screwed onto mouths of the containers for closing purposes. According to the invention, for closing the containers, a final torque is predefined, with which the closing operation is completed, and this final torque is lower than a maximum torque which is applied at least once during the entire closing operation.

The final torque is thus understood to mean the torque with which the closing operation is stopped or ended. This is therefore at the same time the final torque with which the bottle is closed. As mentioned above, this final torque should on the one hand be high enough to ensure a leaktightness of the bottle, and on the other hand it should also be possible for the user to open the container closure without excessive force being required.

According to the invention, during the entire closing operation, a maximum torque is reached which is higher than said final torque. This maximum torque occurs in particular in the time portion in which the tamper-proof strip is being pushed over the corresponding ring over the mouth of the container. While in the prior art the final torque is at least equal to the maximum torque, but in particular is higher than the latter, a reduction in the final torque is achieved by the method according to the invention. Overall, therefore, a high torque is possible in the region of the tamper-proof strip, but at the same time a desired low final torque of the screwed-on closure is possible.

Preferably, the container is held and the torque is applied to the closure of the container.

In one preferred method, for at least one period of time during the closing operation, a torque is possible which is at least equal to the maximum torque. Preferably, the closing device is not subject to any limitations in said period of time during the closing operation, so that the maximum torque is limited only by physical conditions of the closing device. In other words, the torque of the closing device is not limited in said period of time during the closing operation. However, it would also be possible to define, in addition to the final torque, a maximum torque which is less than the torque set by physical conditions of the closing device, such as for example the maximum torque of the motor.

Preferably, at least one variable characteristic of a torque of the closing device is measured. In this case, this variable is particularly preferably measured constantly during the closing operation. Advantageously, the characteristic variable measured is a current, i.e. the current at which a motor which drives the closing device is operated. This current is at the same time an indication of the torque applied or to be applied. However, other variables could also be measured, for example directly the transmitted forces and/or torques.

In a further advantageous method, changes in the characteristic variable during the closing operation are determined. More specifically, it is determined whether the characteristic variable and thus the applied torque increases, stays the same or decreases as a function of time or a rotation angle.

Advantageously, when the torque decreases during closing, the maximum torque of the closing device is set at the predefined final torque. As mentioned above, the maximum torque during the closing operation is reached at the moment in time at which the tamper-proof strip slides over the ring at the mouth of the container. The torque then decreases. The decrease in torque is thus an indication that the tamper-proof strip has now been pushed over the ring on the container. At this moment, therefore, the torque of the closing device can also be set to the final torque in order in this way to ensure that the container is closed only with the final torque.

Preferably, therefore, the closing operation is divided into at least two sections, wherein different torques for rotating the closing bodies are permitted in these sections. In contrast to this, in the prior art just one maximum torque is set, and this depends on the maximum torque which is necessary for applying the tamper-proof strip.

In a further advantageous method, a predetermined limit value for the characteristic variable (D) is determined and, when this limit value is reached, the closure is rotated further by a predefined rotation angle or for a predefined duration starting from the rotary position at which this limit value occurs. While in the above variants based on torque measurements or current measurements it is ascertained that a maximum torque has already been reached and thus the tamper-proof strip has already been pushed over the ring, in this variant the torque is determined in particular before the maximum torque is reached.

Starting from the limit value, the closure is then screwed further by a predefined rotation angle, wherein this rotation angle is sufficient to push the tamper-proof strip over the ring. In this region, the torque is preferably not limited, so that the region with the maximum torque can be overcome.

Preferably, the final torque is set after rotating the closure by the predefined angle, i.e. after overcoming the region which requires the maximum torque.

In a further predefined method, the predetermined limit value is determined temporally before the maximum torque is reached. This means that the predetermined limit value is reached in the rising flank of the torque curve.

The present invention also relates to a device for closing containers. This device comprises a holding device which holds the containers. Also provided is a closing device which rotates container closures relative to the containers and preferably onto the containers, in order to close the latter. According to the invention, a control device is provided which controls a torque with which the closures are rotated relative to the containers, and furthermore a measuring device is provided which determines a value characteristic of this torque, wherein the control device is configured in such a way that it defines for the closing device a final torque which is lower than a maximum torque of the closing device. More specifically, the control device of the closing device preferably defines a final torque which is lower than the maximum torque reached during the closing operation. The measuring device is preferably a current measuring device. This can be integrated directly in the control set-up of a drive motor for the device.

Preferably, the control device determines a temporal curve for the characteristic value during the closing operation. If this characteristic value, i.e. the current intensity, and thus the torque decreases, a maximum torque (or final torque) which is below this determined value of the torque is set for the rest of the curve.

In a further preferred embodiment, the device comprises a rotary position sensor which determines a rotary position of the closure. With the aid of this rotary position sensor, a certain rotary position can be approached once a certain limit value of the torque has been ascertained. The device thus preferably also has a control device which causes the closure to be further rotated by a predefined angle once a certain limit value of the torque has been reached.

Further advantages and embodiments will emerge from the appended drawings:

DETAILED DESCRIPTION

Figure 1:
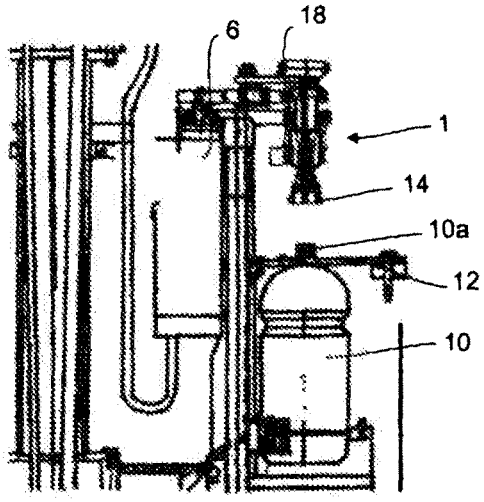
FIG. 1 shows a detail view of a device according to the invention for closing containers.

FIG. 1 shows a detail view of a device for closing containers. Here, reference 10 denotes a container which has a mouth 10*a*, onto which a closure 14 can be screwed. For this purpose, a closing device 1 is provided which firstly moves the container closure towards the mouth 10*a* and then rotates the closure 14 relative to the mouth. Here, the container is held below the mouth just below a carrying ring by a holding device 12. Reference 6 denotes a motor which brings about the rotational movement of the closure relative to the container. This motor 6 comprises a measuring device (not shown) which measures the current applied to the motor. Furthermore, the motor also comprises a control device 16 which controls the applied torque. Reference 18 denotes a rotary position sensor which determines a rotary position of the closure, in particular relative to the container 10.

Figure 2:
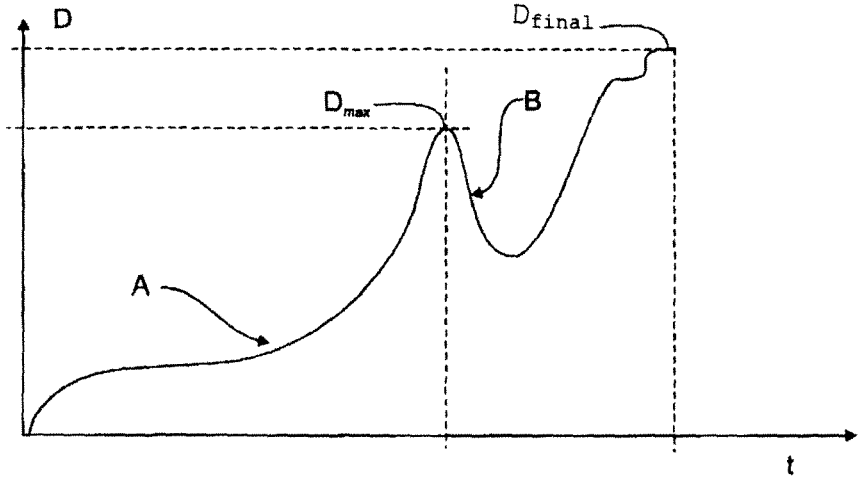
FIG. 2 shows a curve of the torque according to the prior art.
Figure 3:
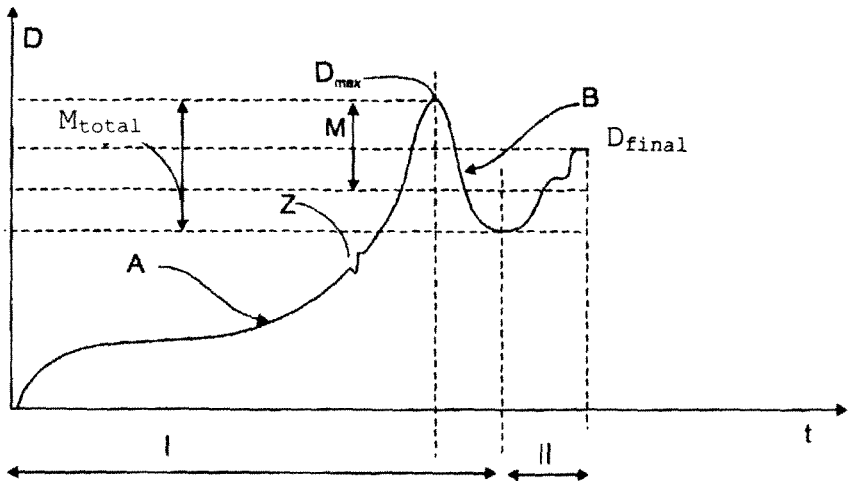
FIG. 3 shows a curve of the torque in the case of a method according to the invention.

FIG. 2 shows a curve of the torque D in the case of a method according to the prior art. The closure is in this case screwed onto the thread 10*a*. As soon as the tamper-proof strip reaches the ring of the mouth, which is also known as the pilfer-proof ring, a suitably high torque $D_{max}$ is required which represents a local maximum and thus an increased current is required for the motor (region A). This increased torque $D_{max}$ is illustrated by the lower dashed horizontal line. As soon as the tamper-proof strip has been overcome and is arranged in its target area, the torque decreases again, as illustrated by the region B. As the curve continues, i.e. as soon as the closure is screwed essentially completely onto the mouth, the torque of the closing device will rise again to a value which is likewise higher than the maximum torque $D_{max}$, for applying the tamper-proof strip. Here, therefore, the final torque must be higher than the screw-on torque of the tamper-proof strip. If the final torque $D_{final}$ were lower, the closure would remain at the rise of the strip and would not tightly close the container 10.

FIG. 2 shows a curve of a torque for a method according to the invention. Here, the final torque $D_{final}$ is lower than the maximum torque $D_{max}$.

In this case, the closing operation is divided into two sections. Firstly, in a first section I which comprises the sections A and B, the maximum torque of the drive device is enabled. If it requires the maximum torque $D_{max}$ to overcome the tamper-proof strip, the required torque decreases thereafter. The current consumption of the servo motor thus also decreases. As soon as the current consumption decreases, this is measured, or more specifically a predefined magnitude of the decrease is measured. A second section II is thus defined, and in this second section II the maximum final torque $D_{final}$ is set. More specifically, only the necessary current for this final torque $D_{final}$ is made available to the drive motor for the closing device. It is thus possible to achieve a final torque which is lower than the maximum torque $D_{max}$.

Preferably, the current is measured over the entire region A and B and the second section is not started until the torque D drops over a relatively large section $\Delta T$. In this way, even small fluctuations in torque can be taken into account, so that the final torque is not inadvertently set at the wrong point in time and in particular too early. In this case, account should be taken of the fact that decreases in the torque may also briefly occur locally in the region A. However, if the final torque $D_{final}$ were already set in this region, the bottle would not be able to be reliably closed.

It is thus possible for example to measure the torque at fixedly predefined time intervals and to set the torque $D_{final}$ only if an actual reduction in torque is ascertained from such a measurement. For illustration purposes, in the region A, a sub-region Z is shown, in which the torque decreases locally. If this region were to be taken as the basis for the machine control, the torque $D_{final}$ would inadvertently already be set in this region. Preferably, therefore, the torque is measured over a longer time range t in order to be able to filter out such measurement fluctuations as in the region Z. Here, the time t is plotted on the ordinate, but it would also be possible to plot on the ordinate a machine angle or rotation angle for the closure.

Reference M denotes an adjustable minimum drop in torque. As soon as the torque, starting from the maximum torque $D_{max}$ drops again below the value represented by the line M, the final torque $D_{final}$ can be set. In this way, too, it is possible to avoid inadvertently setting the final torque $D_{final}$ on the basis of slight fluctuations in the torque D. Reference $M_{total}$ denotes the total drop in torque.

The torque $D_{final}$ is the torque required to tightly close the container.

Figure 4:
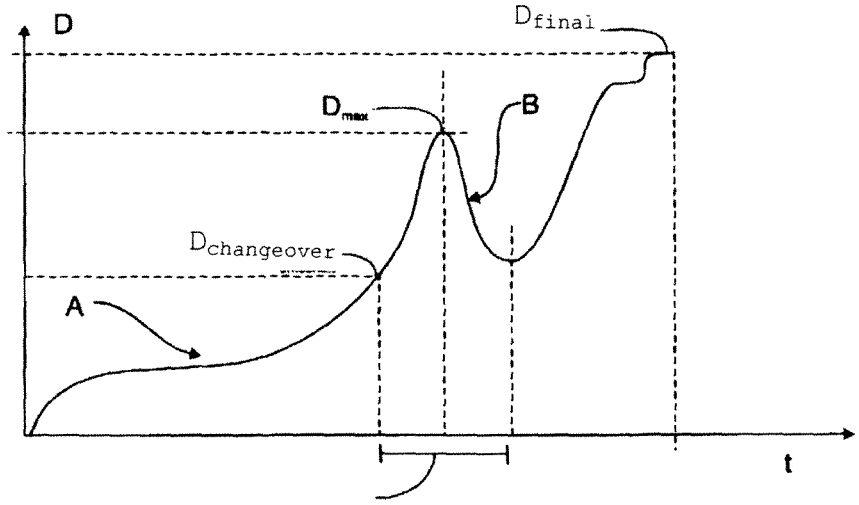
FIG. 4 shows a curve of the torque in the case of a further method according to the invention.

FIG. 4 shows a further method according to the invention. In this method, at the start of the closing operation, a higher current is predefined than is necessary to overcome the increased intermediate torque or the maximum torque $D_{max}$. In this case, even the maximum current consumption of the motor may be permitted.

When the current consumption rises during the closing operation, a predetermined current value is defined as the changeover point $D_{changeover}$. From this current value onwards, or from the rotation angle of the closure 14 corresponding to this current value, the closure is further rotated by a predefined head rotation angle ω (for example by 100°). This rotation angle is selected in such a way that the motor overcomes the maximum torque $D_{max}$ at increased or even maximum current consumption.

As soon as the motor has reached the resulting limit angle, which can be ascertained for example by way of rotary position sensors, the final torque $D_{final}$ is predefined. Also in this way it is possible, in order to overcome a strong tamper-proof strip of the closure, to allow the motor a high current consumption and thus also a high torque. As soon as the tamper-proof strip has been overcome, the current consumption of the motor is limited to the desired final torque of the closure.

Preferably, the abovementioned head rotation angle ω is set in such a way that the rotary position of the closure is in the region of a minimum of the torque. This head rotation angle ω can in this case be determined beforehand based on empirical data. In order to determine this head rotation angle ω, a plurality of the curves shown in FIG. 4 can be evaluated. Furthermore, the device according to the invention may comprise a memory device, in which different head rotation angles ω are stored as a function of different bottle types.

In any case, the head rotation angle ω should be sufficient to rotate the closure from a region A of the curve shown in FIG. 4 into a region B.

The procedure shown in FIG. 4 is particularly suitable in cases in which a high intermediate torque or maximum torque $D_{max}$ occurs. Furthermore, this method is particularly suitable if the torque drop M is very small or is too greatly differentiated due to closure inaccuracies.

Instead of presetting a given rotation angle ω, it would also be possible, starting from $D_{changeover}$, to continue the rotation for a certain duration and then to set the limit to the final torque $D_{final}$ in a defined manner. This duration corresponds to a certain rotation angle, which is sufficient for overcoming the maximum torque $D_{max}$ in a defined manner. In this case, the device preferably has a timer which permits a rotation for the abovementioned duration.

What is claimed is:

1. Method for closing containers with closures, which comprise a tamper-proof strip, by means of a closing device, wherein the closures are rotated onto mouths of the containers for closing purposes, wherein, for closing the containers, a final torque is used, with which the closing operation is completed, and said final torque is lower than a maximum torque, which is applied at least once during the entire closing operation, wherein for at least one period of time during the closing operation, a torque of the closing device is not affected in a limiting manner, wherein at least one characteristic variable of a torque of the closing device is measured and changes in the characteristic variable during the closing operation are determined, wherein, when the torque decreases during closing, the final torque is set, and wherein a predetermined limit value for the characteristic variable is determined and when this predetermined limit value is reached, the closure is rotated further by one of a predefined rotation angle or for a predefined duration.

2. Method according to claim 1, wherein, for at least one period of time during the closing operation, a torque is possible which is at least equal to the maximum torque.

3. Method according to claim 2, wherein the closing operation is divided into at least two sections, wherein different torques for rotating the closing bodies are permitted in these sections.

4. Method according to claim 1, wherein the characteristic variable is a current with which the closing device is operated.

5. Method according to claim 1, wherein the final torque is set after rotating the closure.

6. Method according to claim 1, wherein the predetermined limit value is determined temporally before the maximum torque is reached.

7. Method according to claim 1, characterized in that the maximum torque during the closing operation is reached at the moment in time at which the tamper-proof strip slides over a ring at the mouth of the container.

8. Method according to claim 1, characterized in that during the period of time during the closing operation, in which the torque of the closing device remains unlimited, the closing device is not subject to any limitations so that the maximum torque is limited only by physical conditions of the closing device.

9. Method according to claim 1, characterized in that the predetermined limit value is reached in a rising flank of a torque curve.

10. Method according to claim 1, characterized in that a temporal curve for a characteristic value is determined during the closing operation.

11. Method according to claim 1, characterized in that during the closing process, the container is held below the mouth just below a carrying ring by a holding device.

12. Method according to claim 1, wherein the closing operation is divided into a first section and a second section wherein in the first section, the maximum torque of the drive device is enabled and wherein in the second section, the maximum final torque is set.

13. Method according to claim 12, characterized in that the second section is not started until the torque drops over a predetermined amount such that the final torque is not inadvertently set at the wrong point in time.

14. Method according to claim 13, wherein the final torque is only set if the torque drops over the second section.

15. Method according to claim 1, further comprising:

setting an adjustable minimum drop in torque; and upon detecting that the torque, starting from the maximum torque, drops below the adjustable minimum drop in torque, setting the final torque.

16. Device for closing containers, comprising:

a holding device configured to hold the containers;

a closing device configured to rotate container closures, which comprise a tamper-proof strip, relative to the containers in order to close the containers;

a control device configured to control a torque with which the closures are rotated relative to the containers; and a measuring device configured to determine a value characteristic of said torque, wherein the control device is configured in such a way that it defines a final torque for the closing device that is lower than a maximum torque of the closing device, said maximum torque being reached at least once during the closing operation, wherein for at least one period of time during the closing operation, a torque of the closing device is not affected in a limiting manner, wherein changes in the value characteristic during the closing operation are determined and wherein, when the torque decreases during closing, the final torque is set, and wherein a predetermined limit value for the characteristic variable is determined and when this predetermined limit value is reached, the closure is rotated further by one of a predefined rotation angle or for a predefined duration.

17. Device according to claim 16, wherein the measuring device is a current measuring device.

18. Device according to claim 16, wherein the control device is configured to determine a temporal curve for the characteristic value during the closing operation.

19. Device according to claim 16 wherein the device comprises a rotary position sensor configured to determine a rotary position of the closure.

20. Device according to claim 16, further comprising:

a memory device having stored therein a plurality of predefined head rotation angles, each pre-defined head rotation angle being associated with a different bottle type.

* * * * *